United States Patent [19]

Ostroski et al.

[11] Patent Number: 4,800,615

[45] Date of Patent: Jan. 31, 1989

[54] WET/DRY VAC

[75] Inventors: Richard J. Ostroski, Aurora; James E. Bigley, Warren; John L. Falk, Aurora; E. Charles Sallee, Berea, all of Ohio

[73] Assignee: The Scott Fetzer Company, Cleveland, Ohio

[21] Appl. No.: 35,624

[22] Filed: Apr. 3, 1987

[51] Int. Cl.[4] ..... A47L 7/00

[52] U.S. Cl. ..... 15/353; 15/339

[58] Field of Search ..... 15/321, 320, 339, 353

[56] References Cited

U.S. PATENT DOCUMENTS 3,206,787 9/1965 Daniels et al. ..... 15/320

3,262,146 7/1966 Hays ..... 15/321

3,408,673 11/1968 Oxel ..... 15/320 X 4,559,666 12/1985 Duncan et al. ..... 15/353

*Primary Examiner*—Chris K. Moore

*Attorney, Agent, or Firm*—Watts, Hoffmann, Fisher & Heinke

[57] ABSTRACT

A wet/dry vacuum cleaner unit having a transparent tube on the exterior of its tank that serves as a sight gage to display the volume of water collected in the tank and as a drain hose for conveniently discharging water from the tank. A suspension system molded in the bottom wall of the tank allows the unit to be tipped on its wheels for draining purposes and allows the unit to readily trail the pull of a vacuum hose.

10 Claims, 2 Drawing Sheets

WET/DRY VAC

BACKGROUND OF THE INVENTION

The invention relates to improvements in vacuum cleaning apparatus and, more particularly, to an improved upright tank construction for wet/dry vacuum cleaner units.

PRIOR ART

Upright tank wet/dry vacuum cleaners are known, for example, from U.S. Pat. Nos. 3,082,465 to Wood and 3,775,951 to Eicholz et al. These patents illustrate the conventional practice of providing a ball float valve to shut-off vacuum flow when a tank is filled with water to capacity. A user of this general type of equipment typically has no way of knowing how much water has been collected in the tank until it is completely filled to capacity and the ball valve operates to shut off suction flow. Alternatively, the user may turn the machine off and open the cover for inspection or, possibly, may guess the volume collected in the tank by picking up the tank and judging its weight. A user of limited muscular strength may find it difficult to pick-up, carry and empty a tank containing a substantial volume of water. U.S. Pat. No. 4,068,340 to Forward illustrates a vacuum cleaner tank which is transparent for observation of its contents.

It is customary to support upright tank vacuum cleaner units on wheels to facilitate manual movement of a unit over a floor or other surface. Wheels are of a particular advantage on wet/dry tank units because of the potential volume and weight of water that can be collected in such units. Often, castered wheels have been necessary to support a vacuum cleaner tank so that it will pivot freely and trail a vacuum hose. Castered wheels add to the manufacturing cost of the unit, ultimately increasing the price charged to the consumer.

SUMMARY OF THE INVENTION

The invention provides means for continuously indicating the level of liquid contained in a wet/dry vacuum cleaner tank. The indicator means is formed by a transparent sight tube carried on the exterior of the tank. As disclosed, the tube also serves as a flexible drain conduit and enables the user to empty the tank of liquid without the necessity of lifting and/or tipping it over on its side. The configuration and placement of the sight tube avoids the need for a valve or stopper plug to control discharge of liquid from the tank through its tube.

The tank, in accordance with another aspect of the invention, is floor supported at three points formed by a pair of wheels and a skid plate advantageously positioned with respect to a vacuum motor unit and an inlet hose coupling. The disclosed three point suspension, despite its simplicity and lack of castered wheels, has been found to provide a high degree of maneuverability and allows the unit to trail a vacuum hose even when weighted down by a relatively large volume of collected water.

Preferably, the tank is a unitary body of injection molded, thermoplastic material bottom and side walls integral with each other. The molded tank includes integrally formed nipples for receiving opposite ends of the sight tube. A lower nipple communicates with the interior of the tank adjacent its bottom wall and extends in a horizontal direction so that the section of sight tube affixed to this nipple has a relatively low elevation and thereby affords good drainage. The sidewall of the tank includes a vertically extending recess in which the sight tube nipples are arranged and in which the sight tube is normally carried for protection against impacts and snagging during use. The support wheels are received in wells integrally molded into the tank bottom wall thereby affording a simple means of attachment and low overall height of the vacuum unit. Ideally, the skid plate is formed as a depression in the tank bottom wall.

DESCRIPTION OF THE PREFERRED EMBODIMENT

Figure 1:
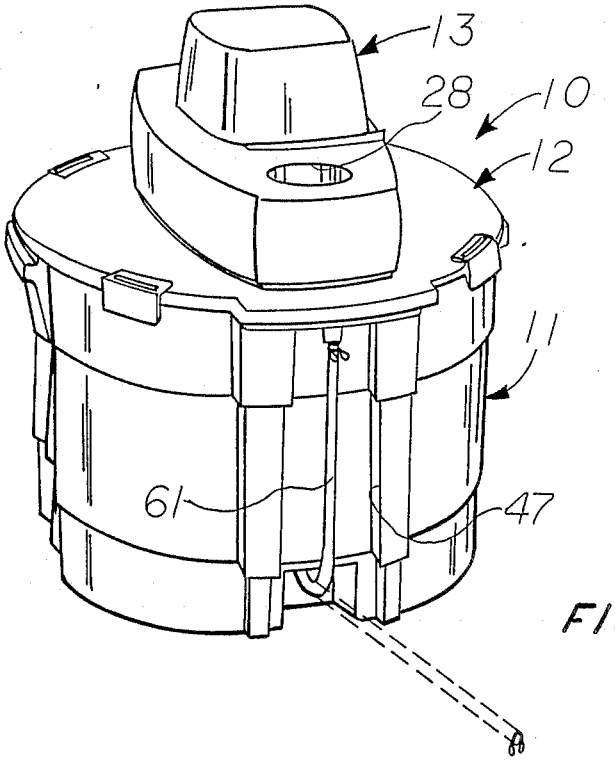
FIG. 1 is a perspective view of a wet/dry upright tank vacuum cleaner constructed in accordance with the invention.

Referring now to the drawings, there is shown a wet/dry vacuum cleaner unit 10 embodying the invention. The vacuum cleaner 10 includes an upright tank or canister 11, a lid 12 closing the open top of the tank 11, a motor housing assembly 13 carried on the lid 12 and a vacuum motor unit 14 within the motor housing assembly.

The tank 11 is preferably an injection molded thermoplastic unitary rigid part formed, for example, of polypropylene. The tank 11 includes a bottom wall 16 and a sidewall 17 forming a chamber 18 for collecting dust, dirt, debris and water-based liquids. An upper edge 19 of the tank is sealed by the lid 12. The lid 12 is removable from the tank 11 for discharging materials collected in the chamber 18. Fluid is drawn into the tank 11 through an inlet 21 by operation of the vacuum motor unit 14. The vacuum motor unit 14 includes an alternating current electric motor 22 driving a fan 23 mounted on a depending vertical shaft 24 of the motor so that the fan rotates about a vertical axis 26 located generally centrally in the tank chamber 18. In the illustrated embodiment, the motor and fan axis 26 is slightly offset (i.e. ⅜ inch compared to a nominal tank diameter of 14 inch at the lid) from an imaginary central vertical plane 42, generally bisecting the tank, to accommodate related air flow passages. Air is drawn from the chamber 18 by the fan 23 and expelled through a duct 27 and an outlet port or coupling 28. The outlet port 28 has the form of a circular opening in the housing assembly 13 and receives air through an integrally molded screen 25. Dirt, dust, debris and like particulate matter is separated from air passing through the tank chamber 18 by a filter assembly 29. A ball float valve 31, buoyant in water, is caged in the filter assembly 29. The ball float valve 31 in the phantom position indicated at 31' in FIG. 2 seals against an annular seat 32 formed on an underside of the lid 12 at an opening 33 to the fan 23.

Figure 3:
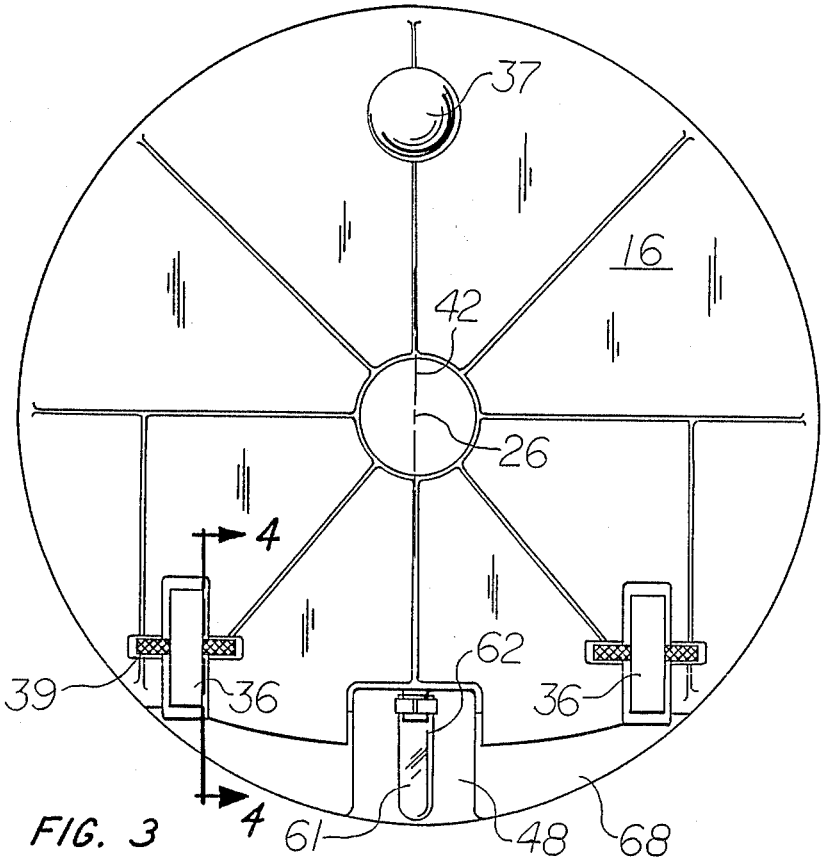
FIG. 3 is a bottom view of the vacuum cleaner.
Figure 2:
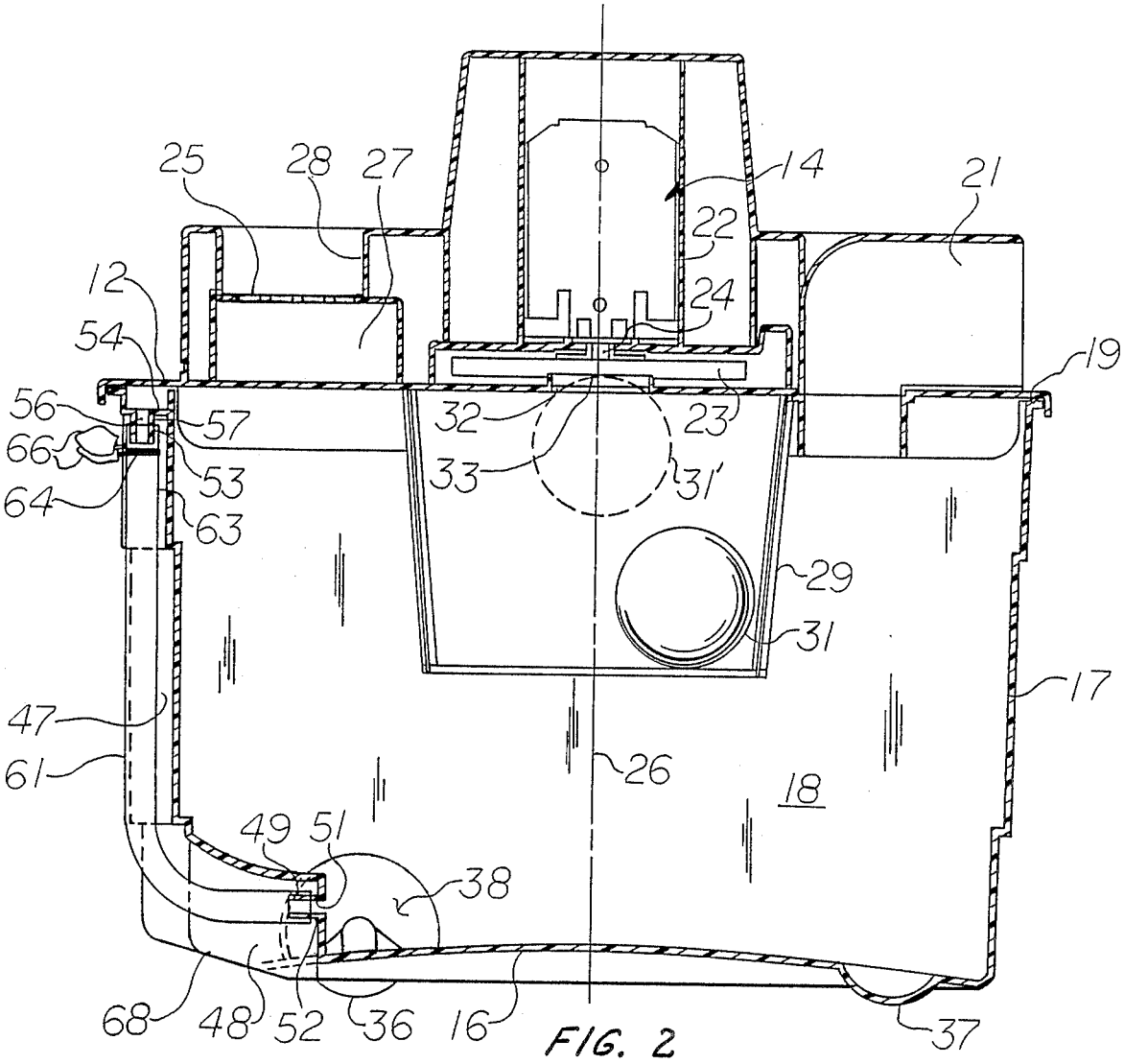
FIG. 2 is a cross-sectional elevational view of the upright tank vacuum cleaner of FIG. 1.
Figure 4:
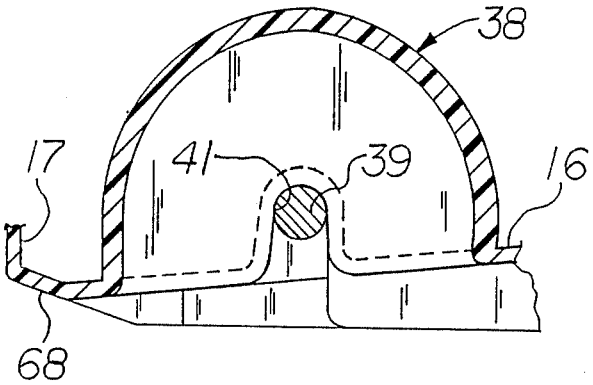
FIG. 4 is a fragmentary cross-sectional view of a portion of the tank, taken in the plane indicated by the lines 4-4 in FIG. 3 illustrating structural details of the mounting of its wheels.
Figure 5:
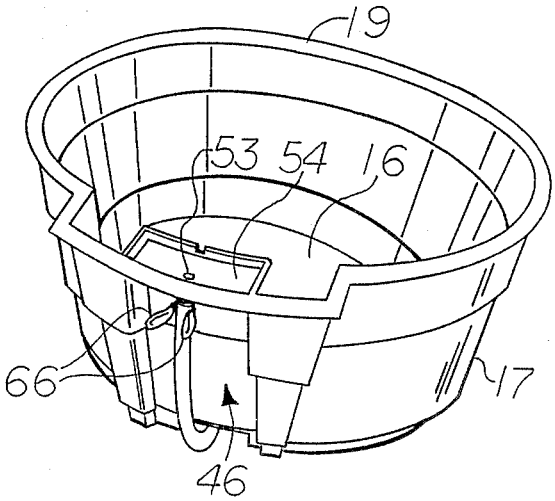
FIG. 5 is a perspective view of the tank and upper end of the sight tube.

The vacuum cleaner unit 10 is supported on a pair of wheels 36 and a skid plate 37. The wheels 36 are each received in a cylindrical well or cavity 38 integrally formed in the tank bottom wall 16. Separate axles 39 for the wheels 36 are retained by a press fit in pockets 41 on opposite sides of the wheel wells 38, the pockets of both wheel wells being co-axial. Ends of the axles 39 may be knurled to assure their retention and prevent their rotation in the pockets 41. As indicated in FIGS. 2 and 4, the pockets 41 support the axles 39 at a plane higher than the bottom wall 16 thereby keeping the overall height and center of gravity of the unit 10 relatively low. As shown in FIG. 3, the wheels 36 are equally spaced apart from the imaginary central plane 42 of the tank 11. The skid plate 37 has the form of a spherical projection depending integrally from the bottom wall 16, having a thickness substantially equal to that of the nominal wall thickness of the bottom wall. The skid plate 37 is centered on the imaginary plane 42. The inlet 21, similarly, is symmetrically arranged on the imaginary vertical plane 42 and is disposed substantially directly vertically above the skid plate (FIG. 2). The inlet 21 has a circular bore with an axis extending generally horizontally. The bore of the inlet 21 is tapered slightly, for example with a 1° draft angle, in a conventional manner to provide a friction lock for releasably coupling a flexible hose therein.

The center of gravity of the motor 22 lies substantially on its vertical shaft axis 26 which is between the axis of the axles 39 and center of the skid plate 37, being somewhat closer to the axis of the axles 39. This disclosed relationship of the wheels 36, skid plate 37, vacuum motor unit 14 and inlet 21 provides a surprisingly well-balanced suspension for the vacuum cleaner unit 10 which enables it to trail behind a conventional flexible hose friction coupled to the inlet 21 as such hose is pulled by the user even though the chamber 18 contains a substantial volume of collected water and despite the fact that the skid plate is a non-rotating, non-swiveling element such as would be afforded by a castered wheel.

A recess 46 is integrally formed in the sidewall 17 and bottom wall 16. The recess 46 is formed of an elongated U-shaped vertical channel portion 47 open to the exterior of the tank side-wall 17 and a short U-shaped horizontal channel portion 48 open to the exterior of the bottom wall 16. A nipple 49 in the lower horizontal channel portion 48 and integral with the tank sidewall 17 projects substantially horizontally at an elevation adjacent that of the bottom wall 16. The nipple 49 includes a bore 51 that communicates directly with the tank chamber 18 and preferably has a length at least euqal to that of the diameter of its generally cylindrical outer surface 52. A second nipple 53 in an upper part of the vertical channel portion 47 is integral with the tank side-wall 17 and depends vertically from a horizontal flange 54. The nipple 53 has an internal bore 56 that communicates with the tank chamber 18 and has a length, preferably, at least equal to the diameter of its outer generally cylindrical surface 57.

A transparent sight tube 61 is assembled on and connects the nipples 49 and 53. The sight tube 61 is preferably a clear, semirigid, flexible conduit of vinyl or other suitable polymeric material. One end 62 of the sight tube is assembled over the lower nipple 53 and is permanently coupled thereto in a liquid tight manner, for example, by a suitable metal clamp. The tube is conveniently cut from stock that is relatively straight and is flexed into the illustrated el shape. The length of the tube 61 is dimensioned so that its opposite upper end 63 is fully received over the nipple 53. The tube length dimension also assures a smooth bend adjacent the junction of the vertical and horizontal channels 47, 48 without a significant projection of such bend or elbow out of these channel portions. As indicated in FIGS. 1 and 2, the channel portions 47, 48 are of sufficient cross-sectional size to substantially fully receive the tube 61 so that its tube is ordinarily protected from contact and snagging with objects during use of the vacuum cleaner unit 10.

The upper tube end 63 is releasably retained over the nipple 53 by a coiled spring clamp 64. The spring clamp 64 includes finger grips 66 which are squeezed together by finger pressure to release the clamp in a known manner.

The sight tube 61 visually displays the level of liquid collected in the tank chamber 18 because such liquid passes through the lower nipple 49 seeking its own level in the tube. The upper nipple 53 allows air-pressure above the liquid to be equalized between the tank chamber 18 and the tube 61. By simply viewing the liquid level displayed in the sight tube 61, a user knows when a sufficient or a certain volume of liquid has been collected in the tank 11 so that vacuum operation can be discontinued and the tank can be emptied.

In accordance with the invention, the tank 11 can be conveniently emptied of collected liquid by using the tube 61 as a drain conduit. This is accomplished by simply disconnecting the tube 61 at its upper end 62 from its associated nipple 53, straightening it in a swinging motion and lowering it to or below the level of the tank bottom wall 16 to allow gravity flow of the liquid. There is no need to pick-up the cleaner unit 10 and its liquid contents to accomplish this draining operation. The upper nipple 53 is disposed adjacent the tank upper edge 19 so that it is above the level of liquid collected in the tank, limited by the ball float valve 31. The buoyancy of the ball float valve 31, its geometry and that of the seat 32 and nipples 53 are such that vacuum air flow through the opening 33 is shut off by the valve at a water level a distance below that of the bottom edge of the nipple. For example, in a tank 11 of 5 or 7 gallon capacity this difference in level can be approximately $1\frac{1}{2}$ inches. Consequently, the tube end can be manipulated on and off the nipple 53 without leakage or dribbling of liquid and the need for a valve on the tube is avoided.

The bottom wall 16 is inclined upwardly in a chordal area 68 outwardly of the wheels 36 and beneath the nipple 49. This turned-up area 68 of the bottom wall 16 allows the vacuum cleaner unit 10 to freely roll on the wheels 36 whenever the skid plate 37 raises from the floor slightly as the unit is pulled with an upwardly directed force component by a hose connected to the inlet 21. The turned-up bottom wall area 68 also allows the unit 10 to pivot on the wheels 36, raising the skid plate side of the unit to assist in draining small quantities of liquid from the chamber 18.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A tank for a wet/dry vacuum cleaner comprising a rigid body with bottom wall and sidewall portions forming a collection chamber, a lid for closing the top of the chamber during normal operation of the cleaner and allowing discharge of collected material from the chamber when open, the collection chamber being substantially liquid-tight for the vacuum collection of liquids therein, a transparent tube external of the body extending upwardly from an elevation adjacent that of the bottom wall portion, a first means connecting a lower end of the tube into fluid communication with the chamber adjacent the bottom wall portion and a second means for connecting an upper end of the tube into fluid communication with the chamber whereby the tube is adapted to visually display the level of liquid contained in the chamber.

2. A tank as set forth in claim 1, including means coupling the tube to the body in a manner whereby the tube can be swung from a generally upright position to a drain position in which liquid contained in the chamber is permitted to drain through the tube by gravity.

3. A tank as set forth in claim 2, wherein the tube is a semi-rigid element with sufficient flexibility to permit a major portion of its length to assume a temporary position with an end thereof at an elevation at least approaching the bottom wall while an opposite end of the tube remains in communication with the chamber.

4. A tank as set forth in claim 3, including a nipple adjacent the bottom wall portion of the body and in communication with the interior of the body, said opposite end of the tube being assembled over said nipple.

5. A tank as set forth in claim 4 wherein said second means includes a second nipple disposed adjacent an upper end of the body, the second nipple being in communication with the chamber, and the tube being removably positioned on said second nipple.

6. A tank as set forth in claim 5, wherein said first-mentioned nipple is generally horizontal, said tube being flexed into an el, the second nipple being generally vertically disposed and thereby contributing to the maintenance of said tube in its el shaped configuration.

7. A tank as set forth in claim 6, wherein said second nipple is arranged to receive the top of the tube at a location adjacent an upper edge of the body.

8. A tank as set forth in claim 1, including a channel integrally formed in the sidewall portion of the body for receiving said tube.

9. A tank as set forth in claim 8, wherein said body is an integrally molded unit, said bottom and sidewalls being integrally formed with one another and forming said tube receiving channel.

10. A tank for a wet/dry vacuum cleaner comprising a rigid body with bottom wall and sidewall portions forming a collection chamber, a lid for closing the top of the chamber during normal operation of the cleaner and allowing discharge of collected material from the chamber when open, the collection chamber being substantially liquid-tight for the vacuum collection of liquids therein, a transparent tube external of the body extending upwardly from an elevation adjacent that of the bottom wall portion, means connecting a lower end of the tube into fluid communication with the chamber adjcent the bottom wall portion whereby the tube is adapted to visually display the level of liquid contained in the chamber, means coupling the tube to the body in a manner whereby the tube can be swung from a generally upright position to a drain position in which liquid contained in the chamber is permitted to drain through the tube by gravity, said tube being a semi-rigid element with sufficient flexibility to permit a major portion of its length to assume a temporary position with an end thereof at an elevation at least approaching the bottom wall while an opposite end of the tube remains in communication with the chamber, a first nipple adjacent the bottom wall portion of the body and in communication with the interior of the body, said opposite end of the tube being assembled over said nipple, and a second nipple disposed adjacent an upper end of the body, the second nipple being in communication with the chamber, and the tube being removably positioned on said second nipple.

* * * * *